US005092136A

United States Patent [19]

Kang

[11] Patent Number: 5,092,136

[45] Date of Patent: Mar. 3, 1992

[54] COOLING AIR SUPPLY GUIDE APPARATUS

[75] Inventor: Mong S. Kang, Suweon, Rep. of Korea

[73] Assignee: Samsung Electronics Co., Ltd., Suweon, Rep. of Korea

[21] Appl. No.: 640,822

[22] Filed: Jan. 14, 1991

[30] Foreign Application Priority Data

Mar. 30, 1990 [KR] Rep. of Korea ..... 90-3777

[51] Int. Cl.[5] ..... F25D 17/08

[52] U.S. Cl. ..... 62/408; 137/872; 415/148

[58] Field of Search ..... 62/408; 415/126, 146, 415/148, 208.1; 137/625.48, 872

[56] References Cited

U.S. PATENT DOCUMENTS

| | | | |
|---|---|---|---|
| 963,277 | 7/1910 | Clifford | 415/148 X |
| 3,276,415 | 10/1966 | Laing | 415/148 X |
| 4,391,564 | 7/1983 | Garkusha et al. | 415/148 X |
| 4,467,627 | 8/1984 | Platt et al. | 415/146 X |
| 4,614,092 | 9/1986 | Kim et al. | 62/187 X |
| 4,789,300 | 12/1988 | Swearunger | 415/148 |
| 4,996,850 | 3/1991 | Boxum et al. | 415/148 X |

*Primary Examiner*—William E. Tapolcai, Jr.
*Attorney, Agent, or Firm*—Cushman, Darby & Cushman

[57] ABSTRACT

The guide apparatus comprises a fan diverging evaporator cooling air into a freezing compartment and a refrigerating compartment, an intaking chamber 5 having the fan 5 mounted at center of therein and encircled part of the fan with a first outside wall and a second outside wall, an incoming passage for the refrigerating compartment and an incoming passage for the freezing compartment individually feeding cooling air into the refrigerating compartment and the freezing compartment, an inside wall formed integrally with the top end of first outside wall at top end portion of the inside wall, a shutter housing having the first outside wall of the intaking chamber encircling part of the fan and the inside wall formed integrally with the top end of the first outside wall at top end portion of the inside wall, the second outside wall facing to the first outside wall and placing the fan between the second outside wall and the first outside wall, the outside walls being flushed with one another, a shutter having a control knob mounted thereon and being moved by the control knob, which being inserted between the inside wall and the first outside wall, and a groove including a shoulder formed at the lower end terminating with the second outside wall and a step cut inside along a cross-sectional wall of the second outside wall, and receiving lower end portion of the shutter.

3 Claims, 7 Drawing Sheets

COOLING AIR SUPPLY GUIDE APPARATUS

BACKGROUND OF THE INVENTION

The invention is related to improving a cooling air supply guide apparatus having a diverging compartment with fan forced circulation, and more particularly to improving a cooling air supply guide apparatus which prevents the vortex turbulent motion of the cooling air fed into the refrigerating compartment and feeds it laminarly into the freezing compartment when the refrigerating compartment is not used.

In a conventional cooling air supply guide apparatus in a refrigerator, the guide apparatus comprises a shutter to close a cooling air incoming passage of a refrigerating compartment when the refrigerating compartment is not in use.

Referring to FIGS. 1 and 2, cooling air generated from an evaporator 4 is diverged into an incoming passage 6 for a freezing compartment and an incoming passage for a refrigerating compartment by a fan 5 of the guide apparatus 1. When both the freezing compartment and the refrigerating compartment are to be used, a control plate 9 in a damper system 8 is opened and cooling air in the incoming passage 7 is fed to the refrigerating compartment 3 and cooling air in the incoming passage 6 is fed to the freezing compartment 2. When the refrigerating compartment 3 is not to be used, the control plate 9 is closed, and cooling air in the incoming passage 7 flows around and is fed to the freezing compartment 2 through the incoming passage 6. The above structure is disclosed in detail in U.S. Pat. No. 4,614,092.

The incoming passage 7 closed by the control plate 9 is a closed and narrow passage. Cooling air flow in the closed and narrow passage is turbulent and flow spirally in the incoming passage 7 and to the intaking chamber 10 to make the cooling air in the intaking chamber 10 vortex. The vortex flow results in resistance against the fan 5 and increases the load of refrigerator, decreasing the rotary power of the fan 5, thereby losing the balance of the fan 5 and causing noises in the guide apparatus.

SUMMARY OF THE INVENTION

In view of the foregoing problems, an object of the present invention is to provide a cooling air supply guide apparatus which blocks an inlet of the incoming passage, thereby allowing cooling air in the intaking chamber to flow laminarly.

Another object of the present invention is to provide a guide apparatus which decreases vortex flow by enabling laminar flow of the cooling air in the intaking chamber and decreases the load of the refrigerator, thereby increasing rotary power of the fan.

Another object of the present invention is to provide a guide apparatus which decreases vortex flow and rotates the fan in balance, thereby decreasing noises.

According to the present invention, the cooling air supply guide apparatus, diverging evaporator cooling air into a freezing compartment and a refrigerating compartment with fan forced circulation, comprises a shutter housing having a first outside wall of an intaking chamber encircling part of the fan and an inside wall formed integrally with the top end of the first outside wall at top end portion of the inside wall, and a second outside wall facing the first outside wall with the fan placed between the second outside wall and the first outside wall, the outside walls being flush with one another. A shutter having a control knob mounted thereon for mounting the shutter inserted between the inside wall and the first outside wall is used. A groove including a shoulder formed at the lower end terminating with the second outside wall and a step cut inside the second outside wall to receive the lower end portion of the shutter are used.

Since the feature of the shutter is formed with the structure causing laminar flow of cooling air, cooling air in the intaking chamber flows along the first outside wall, the shutter and the second outside wall, thereby enabling laminar flow in the intaking chamber.

DESCRIPTION OF THE PREFERRED EMBODIMENT

Figure 1:
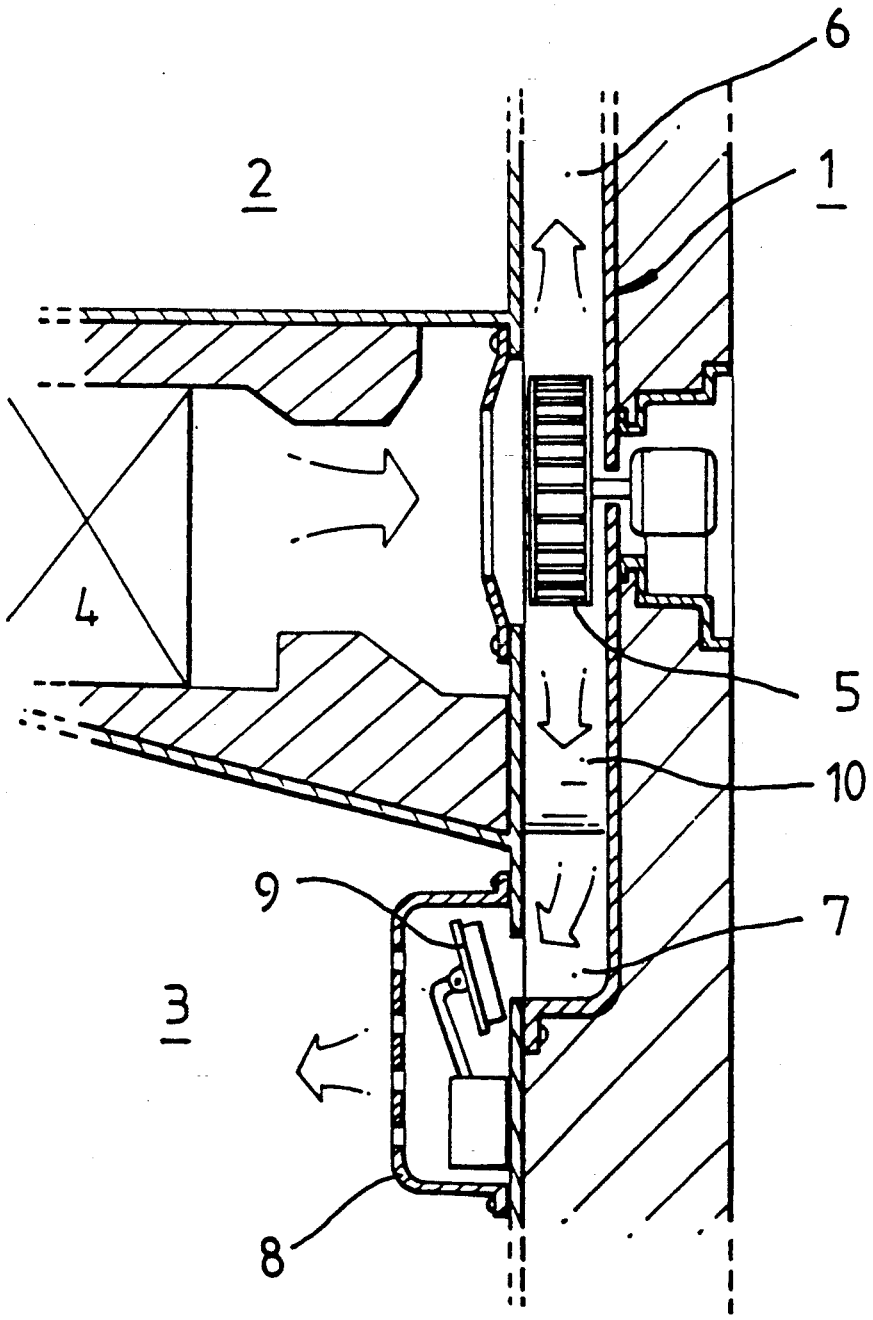
FIG 1 (PRIOR ART)
FIG. 1 is a sectional view illustrating a cooling air supply guide apparatus according to the prior art.
Figure 2:
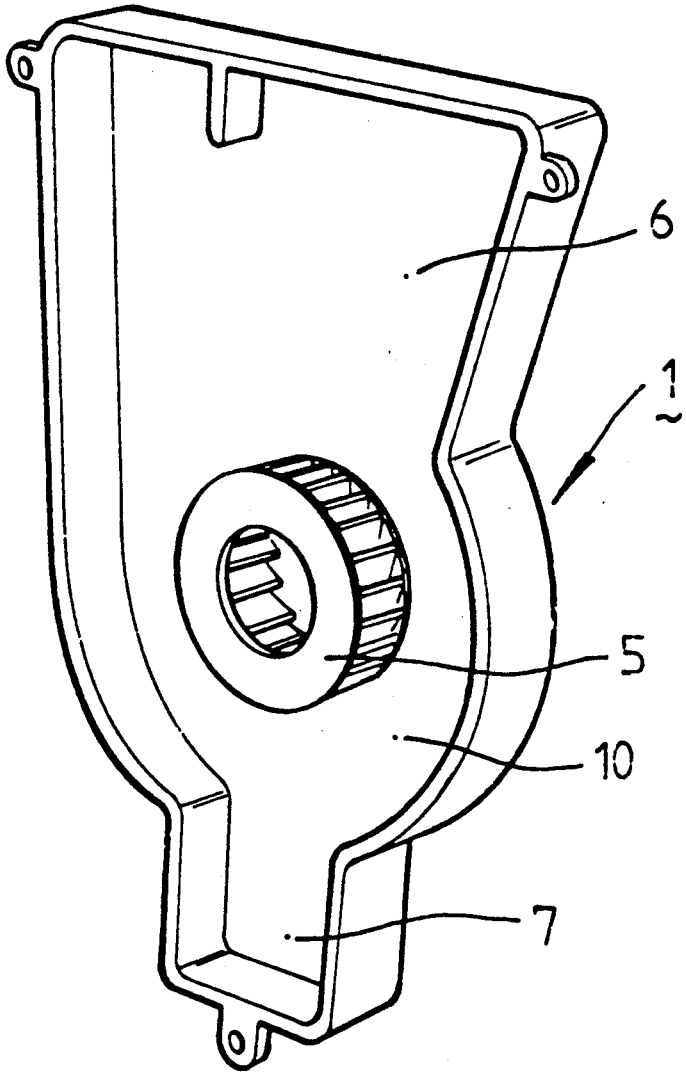
FIG 2 (PRIOR ART)
FIG. 2 is a perspective view of a cooling air supply guide apparatus according to the prior art.
Figure 3:
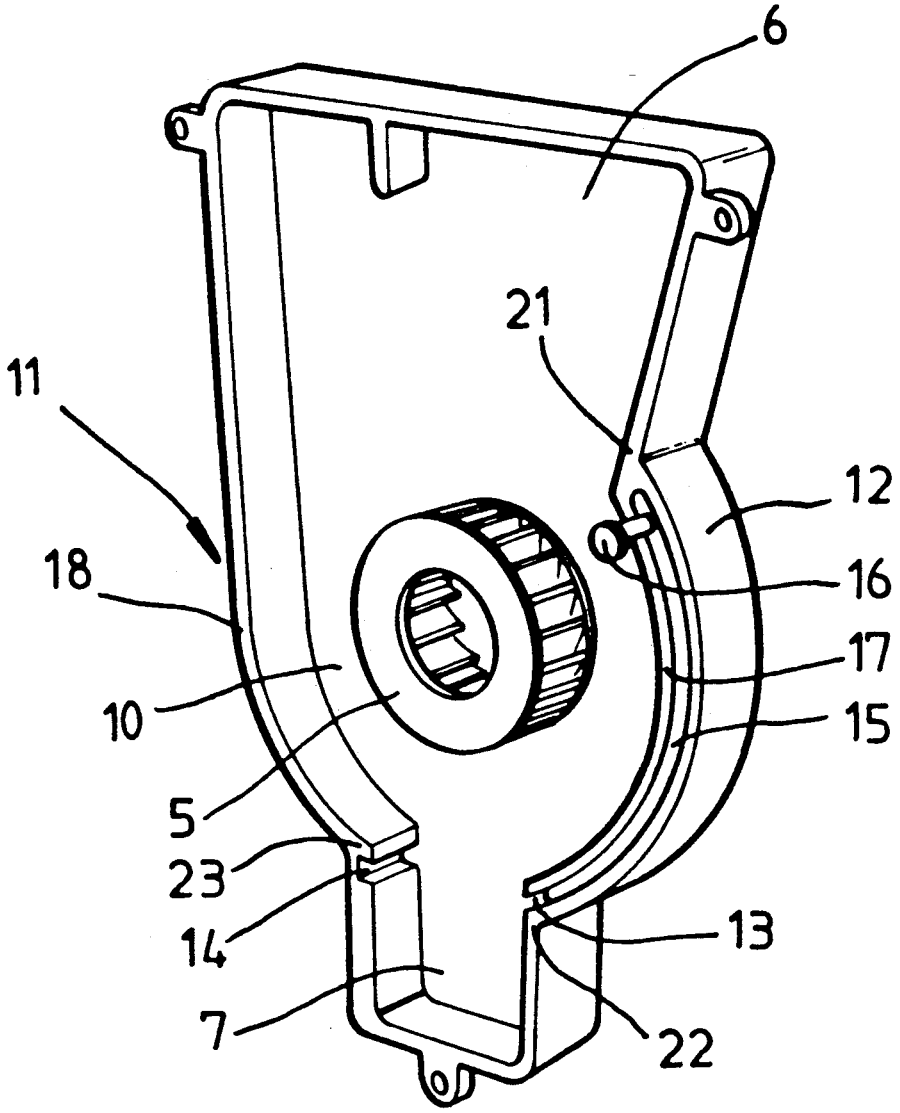
FIG. 3 is a sectional view illustrating a cooling air supply guide apparatus according to the present invention.

FIG. 3 illustrates a cooling air supply guide apparatus 11 in accordance with the preferred embodiment of the present invention.

The guide apparatus comprises a fan 5 diverging evaporator cooling air into a freezing compartment and a refrigerating compartment, an intaking chamber 10, having the fan 5 mounted at the center thereof, encircling part of the fan 5 with a first outside wall 12 and a second outside wall 18. An incoming passage 7 for the refrigerating compartment and an incoming passage 6 for the freezing compartment individually feed cooling air into the freezing compartment and the refrigerating compartment, respectively. An inside wall 17 is formed integrally with the top end of first outside wall 12 at top end portion of the inside wall 17. A shutter housing 13 is used which includes the first outside wall 12 of the intaking chamber 10 and the inside wall 17 and the second outside wall 18 facing the first outside wall 12. The fan 5 is placed between the second outside wall 18 and the first outside wall 12, the outside walls 12,18 being flush with one another. A shutter 15 having a control knob 16 mounted thereon for moving the shutter 15 which is inserted between the inside wall 17 and the first outside wall 12. A groove 14 includes a shoulder formed at the lower end terminating with the second outside wall 18 and a step cut inside along the second outside wall 18 for receiving the lower end portion of the shutter 15.

Incoming passage 6, incoming passage 7, fan 5, intaking chamber 10 and second outside wall 18 are the same as those of the prior art, therefore a detailed discussion of these is omitted.

The center and radius of the curvature of the inside wall 17 are same as those of the second outside wall 18. The upper end of the inside wall 17 is connected integrally with a bottom wall 21 of the incoming passage 6 and a top end of the first outside wall 12 as will be described later.

The inside wall 17 extends from the bottom wall 21 of the incoming passage 6 toward close proximity to the first inlet wall 22 of the incoming passage 7. The center of curvature of the first outside wall 12 is the same as that of the inside wall 17. The radius of curvature of the first outside wall 12 is larger than that of the radius of curvature of the inside wall 17. The first outside wall 12 connects integrally with the first inlet wall 22 and extends from the bottom wall 21 to the first inlet wall 22 of the incoming passage 7. The shutter housing 13 is formed between the inside wall 17 and the first outside wall 12. The center of curvature of the shutter 13 is in the same manner as that of the inside wall 17 and the first outside wall 12. Radius of curvature of the shutter housing 13 is smaller than that of the first outside wall 12 with a predetermined length and is larger than that of the inside wall 17.

The shutter housing 13 is formed with the closed bottom wall 21 portion between the first outside wall 12 and the inside wall 17, and with the opened first inlet wall 22 portion and extends from the bottom wall 21 portion to the first inlet wall 22 portion along the whole length with a predetermined uniform gap.

At the second inlet wall 23 of the incoming passage 7 the groove 14 is formed having the same radius of curvature as that of the shutter housing 13 and having the same predetermined uniform gap as the one of the shutter housing and having a predetermined step cut to receive end portion of the shutter 15.

Figure 4:
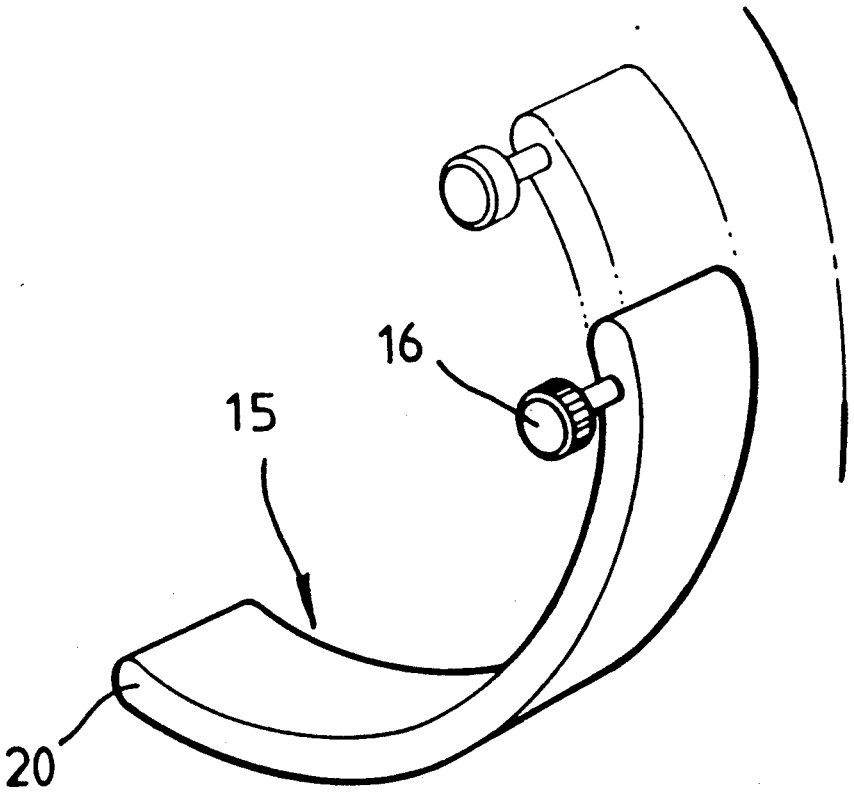
FIG. 4 is a perspective view of the shutter member according to the present invention.

FIG. 4 illustrates the shutter 15 according to this invention.

The shutter 15 has a predetermined thickness to slideably move in the shutter housing 13. The radius and the center of curvature of the shutter 15 are same as those of the shutter housing 13, and also, the width of the shutter 15 is the same as the width of the inside wall 17, the first outside wall 12 and the second outside walol 18. Therefore, the end portion 20 of the shutter 15 fits into the groove 14. The control knob 16 of the shutter 15 is threadably mounted into a predetermined place in upper portion of the shutter. The shutter 15 formed as described above and is slideably insertable into the shutter housing 13.

Figure 5:
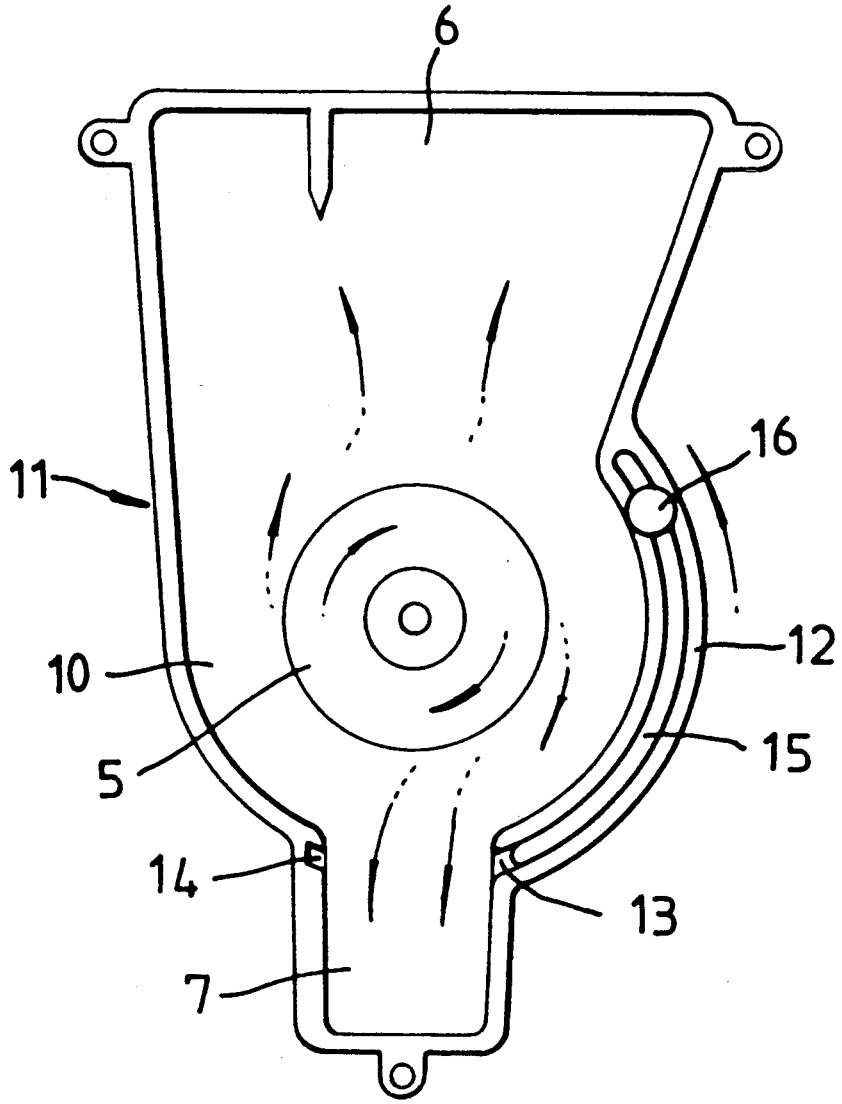
FIG. 5 is a front view illustrating the shutter in an open position.
Figure 6:
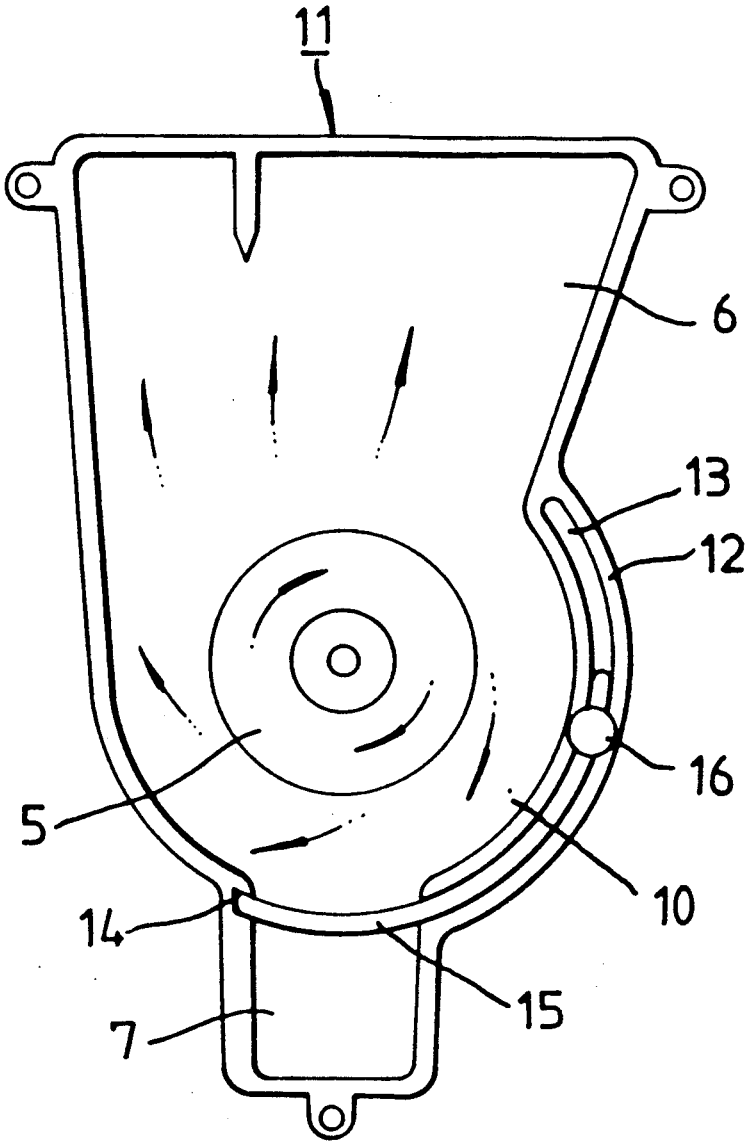
FIG. 6 is a front view illustrating the shutter in a closed position.

FIG. 5 and FIG. 6 are front views illustrating the open and closed conditions of the shutter 15, respectively.

When both the freezing compartment and the refrigerating compartment are being used, the control knob 16 is moved counterclockwise as shown in FIG. 5. Thus cooling air is diverged into the incoming passage 7 and the incoming passage 6.

When only the freezing compartment is being used, the control knob 16 is moved clockwise as shown in FIG. 6. Thus, the incoming passage 7 is blocked by the shutter 15. And cooling air fed into the incoming passage 7 is fed into the incoming passage 6 along the cofiguration of the shutter 15 and that of the second outside wall 18.

Figure 7:
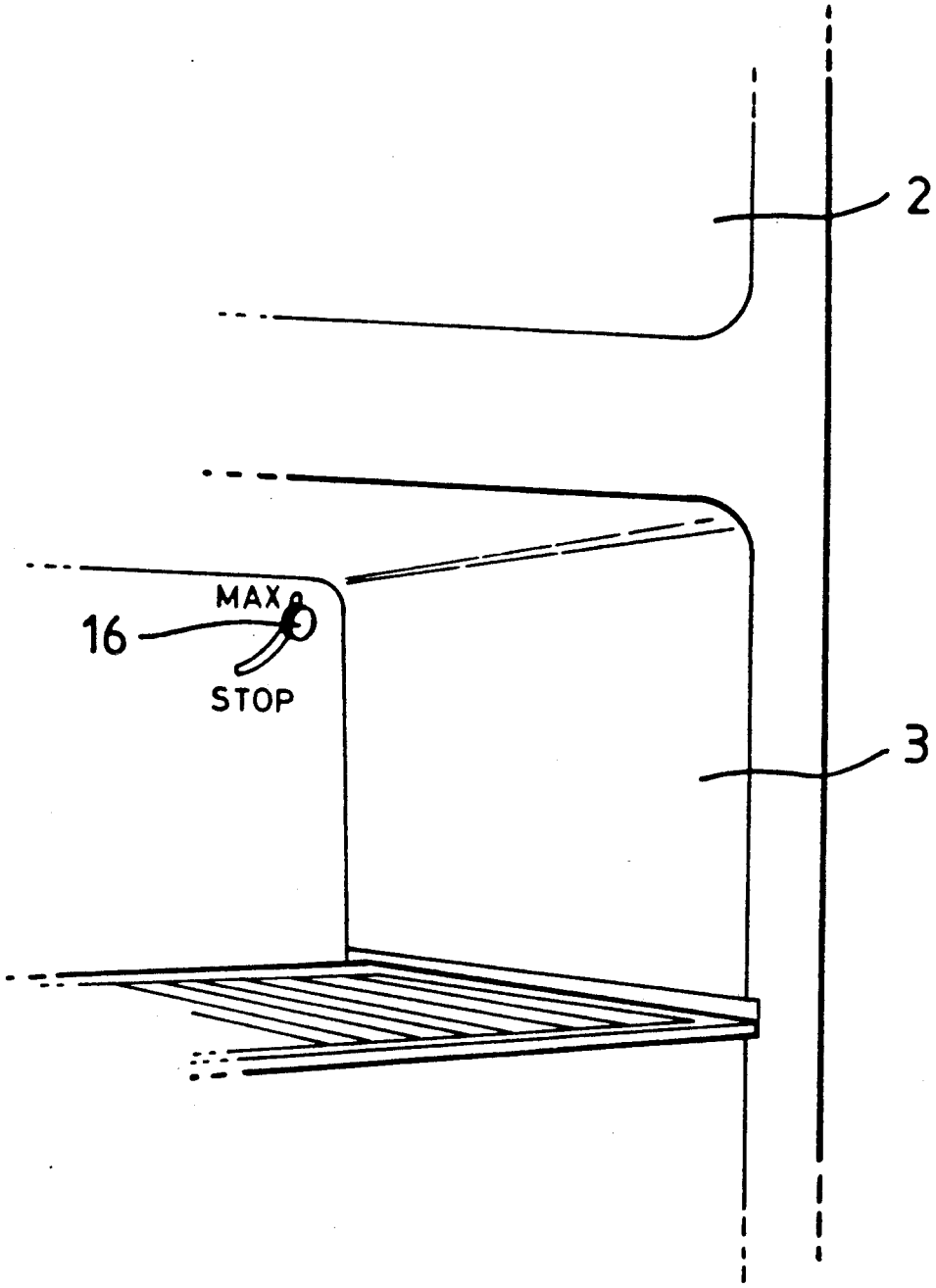
FIG. 7 is a perspective view of the apparatus of the present invention mounted in a refrigerator.

Additionally, when cooling air with a required volume is to be fed to the refrigerating compartment, the control knob 16 moves to the indicate the cooling extent, such as "MAX" "STOP" etc., on the rear wall of the refrigerating compartment as shown in FIG. 7. Thus, the required condition is obtained in the refrigerating compartment.

According to the invention, the shutter blocks the inlet of the incoming passage for the refrigerating compartment and prevents vortex flow from occurring in the incoming passage for the refrigerating compartment. This increases the rotary power of the fan, the load capacity of the refrigerator and rotates the fan in a balanced state and thus decreases noise. Also, the volume of cooling air is supplied according to the desired condition of the refrigerator.

What is claimed:

1. A cooling air supply guide apparatus for diverging evaporator cooling air into a freezing compartment and a refrigerating compartment with fan forced circulation comprising:

a shutter housing having a first outside wall of an intaking chamber encircling part of said fan and an inside wall spaced apart from and formed integrally with a top end of the first outside wall at a top end portion of said inside wall, a second outside wall facing said first outside wall;

a fan placed between said second outside wall and said first outside wall with said outside walls being flush with one another;

a shutter having a control knob mounted thereon for moving said shutter inserted between said inside wall and said first outside wall; and a groove formed at a lower end terminating with said second outside wall with a step cut inside of said second outside wall for receiving a lower end portion of said shutter.

2. The supply guide apparatus as in claim 1, having a center of curvature of said first outside wall the same as the center of curvature of said inside wall and said shutter; and a radius of curvature of said inside wall being less than that of said shutter, and said radius of curvature of said shutter being less than that of said first outside wall.

3. The supply guide apparatus as in claim 1 having a same center of curvature of said shutter housing the same as that of said groove; and having said radius of curvature of said shutter the same as that of said groove.

* * * * *